US005524400A

United States Patent [19]

Schmechel

[11] Patent Number: 5,524,400

[45] Date of Patent: Jun. 11, 1996

[54] WALL ASSEMBLY AND METHOD OF MAKING THE SAME

[76] Inventor: Douglas A. Schmechel, 19993 WCR #5, Berthoud, Colo. 80513

[21] Appl. No.: 224,803

[22] Filed: Apr. 8, 1994

[51] Int. Cl.[6] ..... E06B 3/54

[52] U.S. Cl. ..... 52/474; 52/309.7; 52/236.7

[58] Field of Search ..... 52/474, 777, 778, 52/779, 309.4, 309.7, 309.11, 236.6, 236.7, 236.9, 238.1, 241, 475.1

[56] References Cited

U.S. PATENT DOCUMENTS

| | | | |
|---|---|---|---|
| 4,094,110 | 6/1978 | Dickens et al. | 52/80 |
| 4,241,555 | 12/1980 | Dickens et al. | 52/454 |
| 4,284,447 | 8/1981 | Dickens et al. | 156/78 |
| 4,633,634 | 1/1987 | Nemmer et al. | 52/474 |
| 4,961,298 | 10/1990 | Nogradi | 52/235 |
| 5,265,389 | 11/1993 | Mazzone et al. | 52/309.7 |
| 5,333,426 | 8/1994 | Varoglu | 52/236.7 |

OTHER PUBLICATIONS

"R–Control® Panel Building System", AFM Corporation, A579 07420/AFN, BuyLine 3692.

"Coreform™ Building System, The Global Solution", Coreform Industries.

"Wallframe™ The Better Building Material", Wallframe, Inc.

"Stolite Panel System", Innovative Components, Inc. (Apr./1991).

*Primary Examiner*—Creighton Smith

*Attorney, Agent, or Firm*—David S. Woronoff

[57] ABSTRACT

A wall assembly of a building structure which utilizes a plurality of panels having preformed grooves thereon and supports which interface with these grooves. Supports are positioned within the various grooves of each of the panels and are appropriately interconnected. In one embodiment, these panels are made from styrofoam and the supports are generally U-shaped, steel studs. A plurality of these panels may be positioned adjacent to each other and the U-shaped studs may be interconnected in a manner which provides a desired degree of structural integrity.

7 Claims, 10 Drawing Sheets

FIG. 1
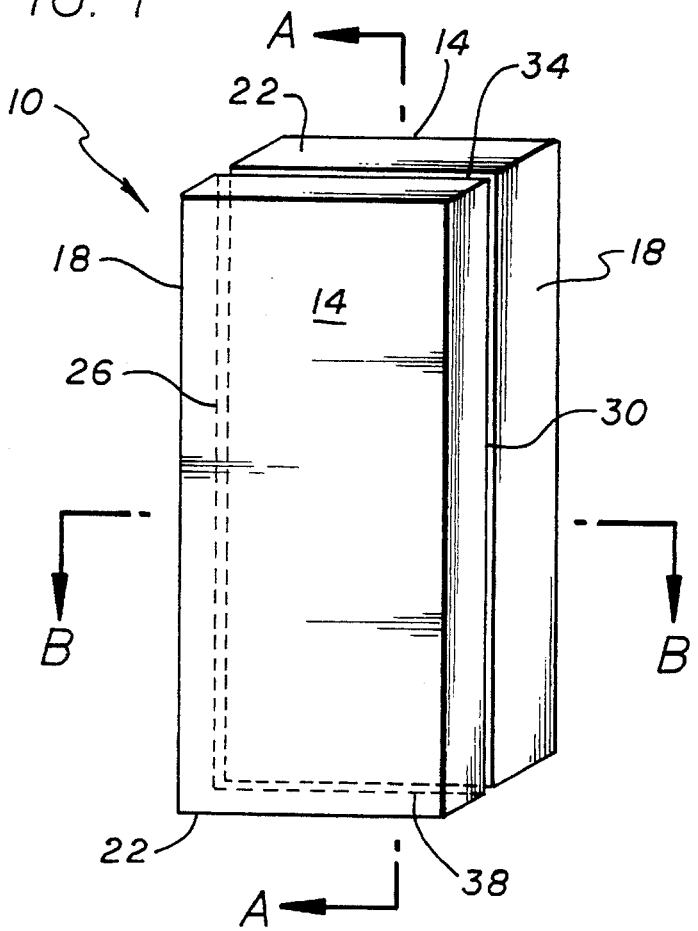
FIG. 1A
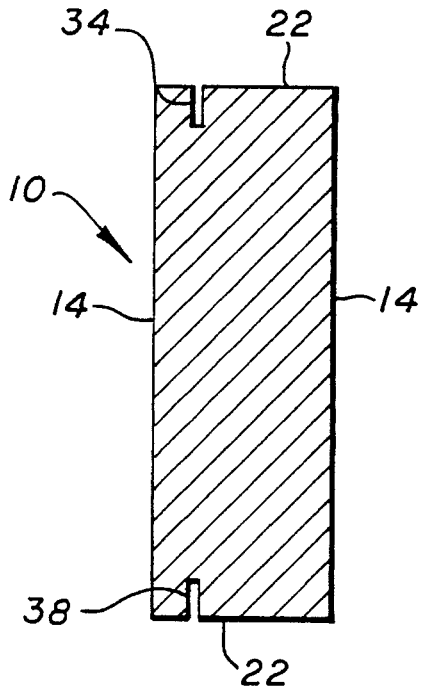
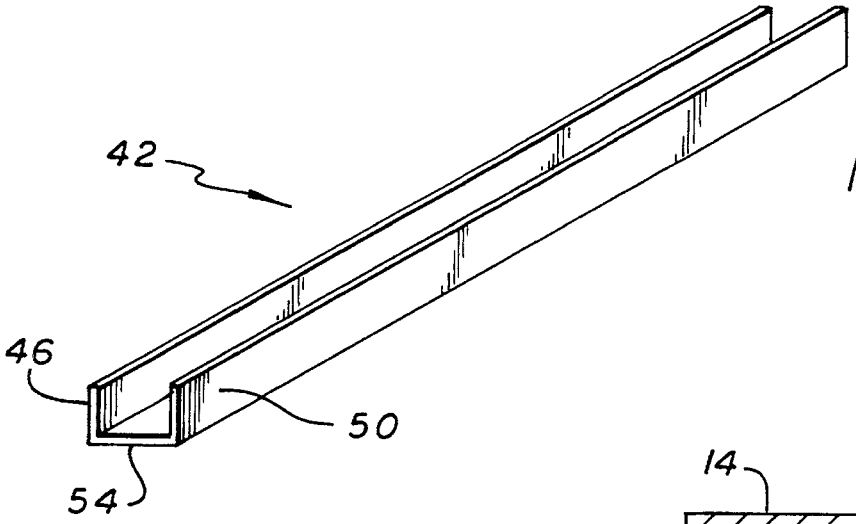
FIG. 2
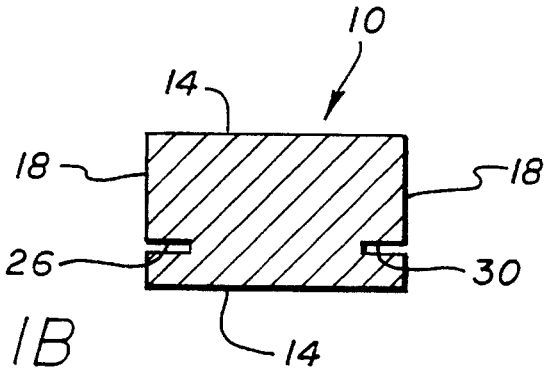
FIG. 1B

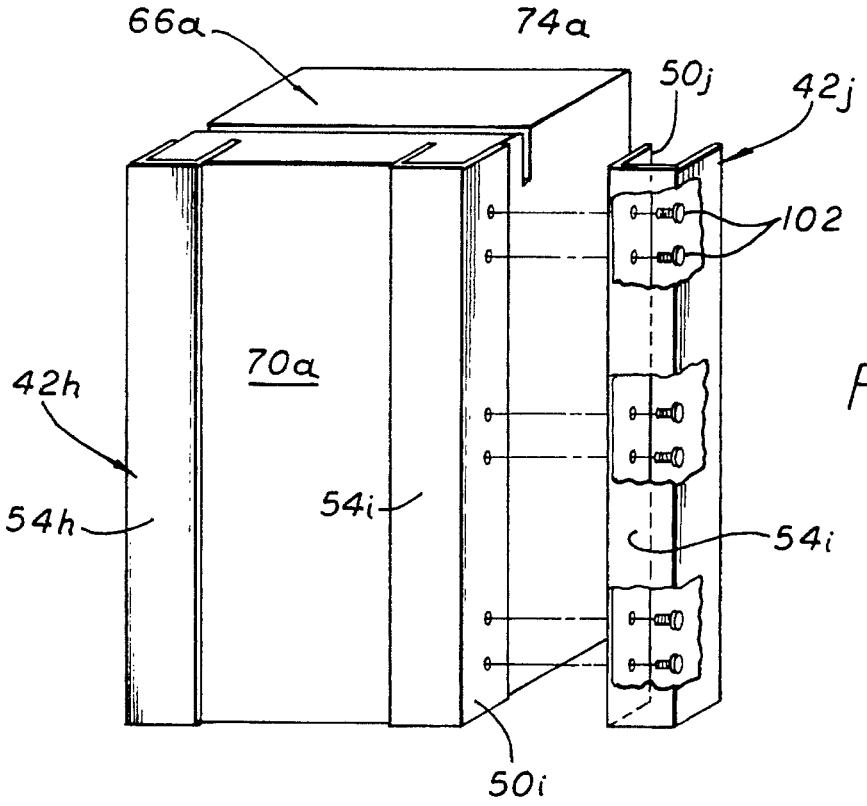
FIG. 5A
FIG. 5B
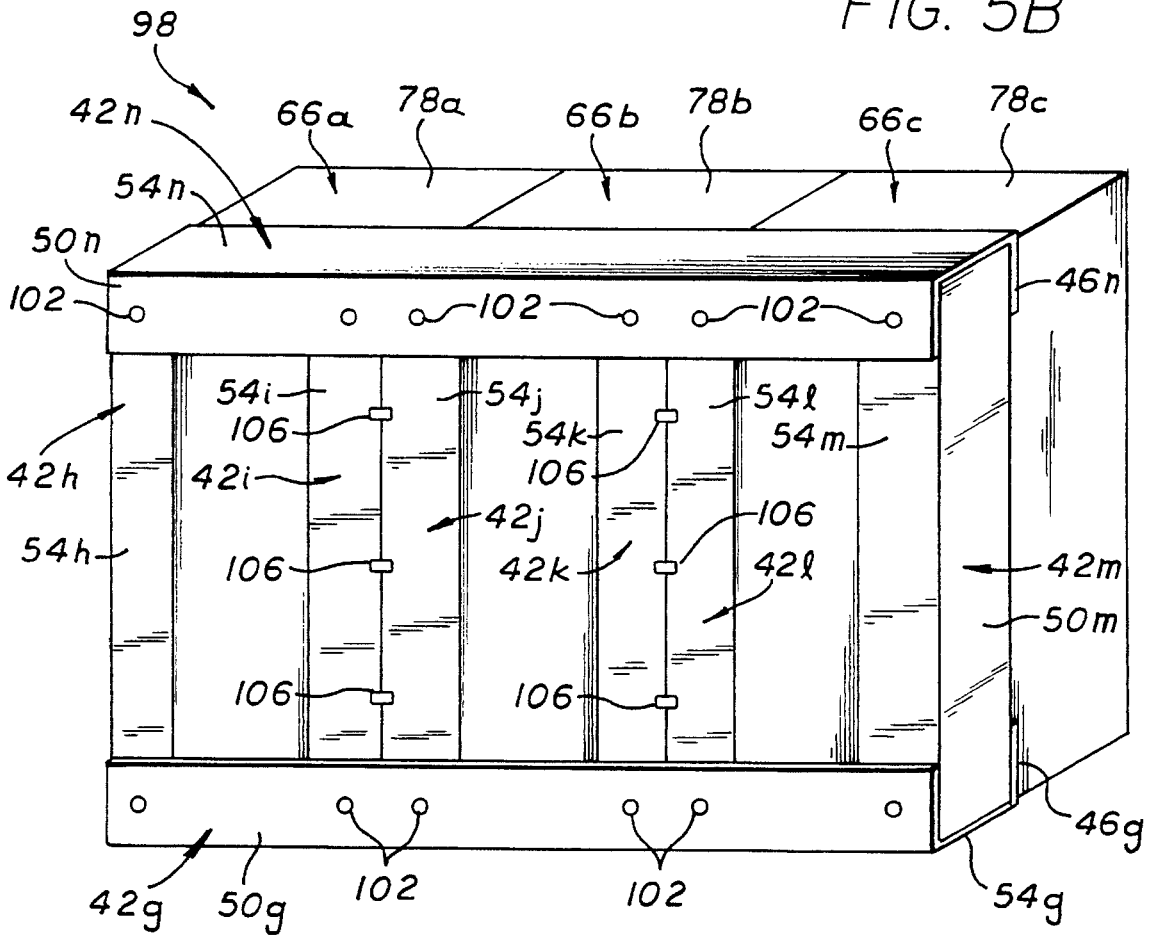

FIG. 6
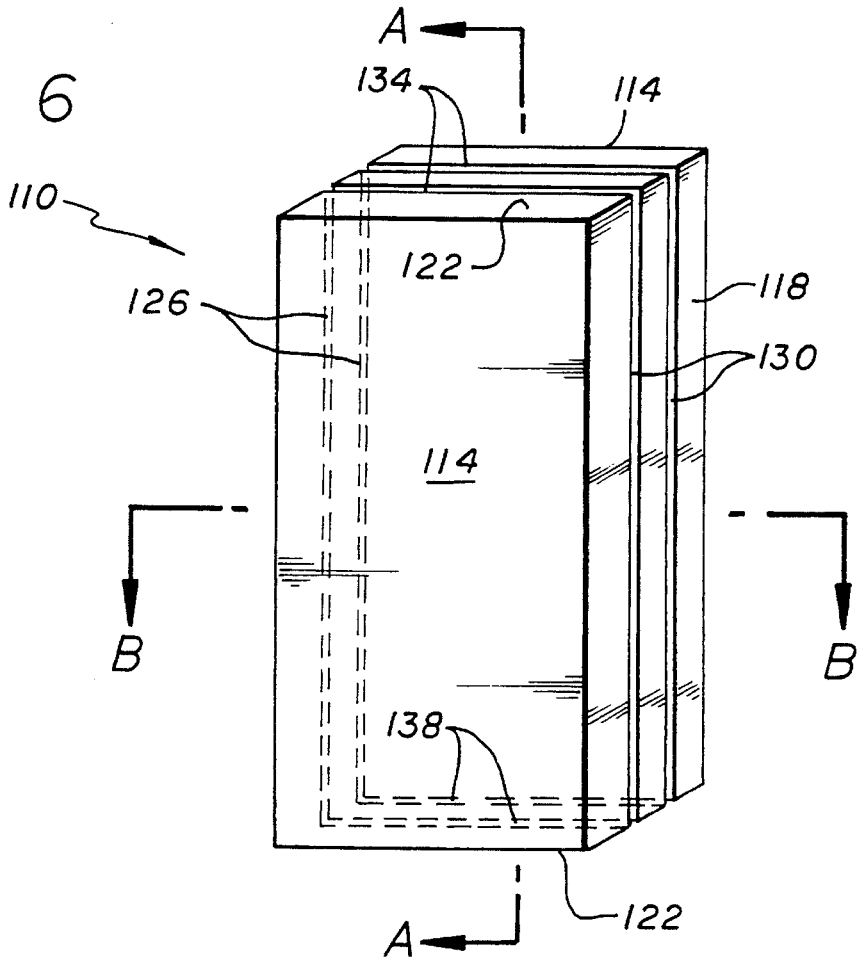
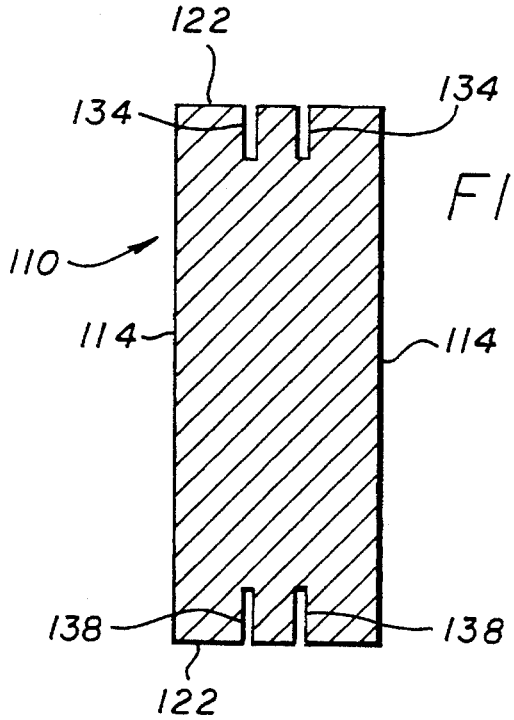
FIG. 6A
FIG. 6B
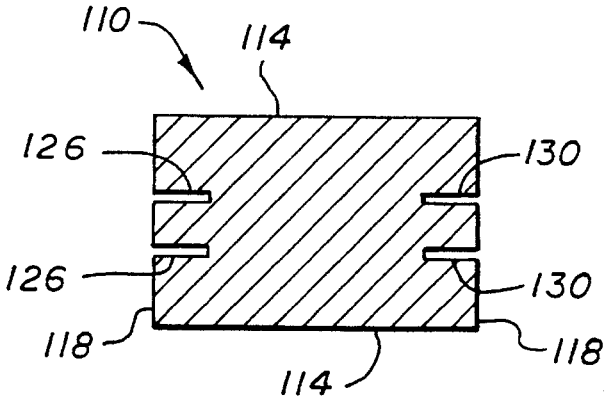

WALL ASSEMBLY AND METHOD OF MAKING THE SAME

FIELD OF THE INVENTION

The present invention generally relates to the field of building construction and, more particularly, to a wall assembly of a building structure which is assembled from a plurality of panels having preformed grooves thereon and from a plurality of supports which are installed in these grooves and are appropriately interconnected.

BACKGROUND OF THE INVENTION

Conventional residential construction techniques are based upon a frame substructure. That is, the initial task in the construction of the walls is framing. More specifically, a series of vertically extending studs (e.g., two-by-fours) are spaced between and nailed to top and bottom horizontally extending studs (e.g. two-by-fours) to form a frame for a given wall. This frame structure is typically nailed together on the ground and is thereafter raised and anchored to the building structure's floor and interconnected with adjacent walls. This aspect of the construction is relatively labor intensive and typically two or more laborers are utilized when standing and interconnecting the frames of each wall.

Once all of the walls of the building are constructed in the above-noted manner, typically four-by-eight sheets of plywood are nailed to the frame on its exterior surface. Insulation may be positioned between the vertically extending studs on the inside of the frame and/or sheets of insulation may be positioned over the plywood exterior. Nonetheless, siding and dry wall are installed on the exterior and interior surfaces, respectively, of the frame. Insulating, siding, and hanging dry wall are each separate steps and thus this aspect of the construction is also relatively labor intensive. Moreover, due to the size and/or weight of the plywood, siding, and dry wall, typically two or more laborers are used in this aspect of the construction as well.

Based upon the foregoing, it can be appreciated that conventional residential construction techniques are both material and labor intensive. As the costs of materials and labor increases, so to then does the cost of the residential building structures. Considering that there is an ever-increasing need for low income housing, there is a corresponding need for an alternative to conventional residential construction techniques which will allow for the desired cost reduction.

SUMMARY OF THE INVENTION

The present invention generally relates to the construction of a building structure and, more specifically, to the construction of the walls forming the building structure. In this regard, the present invention utilizes a plurality of panels (e.g. rectangular sheets having front and back surfaces, two laterally displaced side surfaces, and two longitudinally displaced end surfaces). These panels each have a plurality of grooves formed thereon such that a wall may be assembled by installing support members on the panels using these grooves. The supports associated with the various panels are appropriately interconnected, directly or indirectly, to provide a desired degree of structural integrity for the wall.

In one embodiment, each panel has at least two longitudinal grooves which are laterally displaced (e.g. supports installed thereon are vertically extending). A method in accordance with principles of the present invention includes standing one of the panels on its lowermost end surface and positioning at least part of a support in one of its longitudinal grooves, and positioning another of the panels on its lowermost end surface and positioning at least part of another support in one of its longitudinal grooves. When the panels are positioned substantially adjacent to each other (e.g., such that adjacent side surfaces are in abutting engagement) and the noted supports are interconnected, directly or indirectly, at least a portion of a wall assembly is formed. This methodology may be repeated any number of times to form a wall assembly for a building structure of a desired length.

The noted longitudinal grooves may assume a variety of positions on the panels. For instance, one longitudinal groove may be positioned on each of the two side surfaces of the panels (those surfaces which abut the side surface of an adjacent panel). In this case, the supports may be generally U-shaped such that one part of the support will fit in the associated longitudinal groove, another part of the support will be in substantial abutting engagement with part of the corresponding side surface, and the remaining part of the support will be in substantial abutting relationship with the front or back surface of the panel (those surfaces which form the interior and exterior surfaces of the wall). Consequently and in this case, two supports of adjacent panels may be positioned in substantial abutting engagement and directly connected to each other by, for instance, one or more appropriate fasteners (e.g., screws, bolts, rivets). In order to directly connect the abutting portions of the supports to each other in this case, the connection should be established prior to positioning the supports in the longitudinal grooves of both of the panels. That is, one support may be installed on one panel and another support may be attached thereto prior to this other support being installed on its associated panel.

As an alternative to the above, each of the noted panel side surfaces may have two longitudinal grooves formed thereon such that the noted generally U-shaped supports are totally contained within the extent of the side surface. That is, a portion of an installed support is in abutting relation with part of the associated side surface. In this case and in order to directly connect the abutting portions of the supports of adjacent and abutting panels, it is necessary to establish this direct connection prior to positioning the subsequently installed panel adjacent to the initially installed panel, and thus prior to positioning its associated support in the longitudinal grooves of the subsequently installed panel. That is, one support will be installed on one panel and another support will be attached thereto prior to this other support being installed on its associated panel.

A further alternative is to have a pair of longitudinal grooves on the front and/or back surface of each panel with these grooves being substantially proximate opposite side surfaces. In this case, a part of a generally U-shaped support fits in one of these longitudinal grooves, part is in substantial abutting relationship with the front or back surface on which the longitudinal grooves are formed, and part is in substantial abutting relationship with at least part of one of the respective panel's side surfaces. Consequently, parts of the supports of adjacent panels would be in substantial abutting relationship and could be appropriately interconnected.

Each of the noted panels may also have at least one lateral groove on at least one of its two end surfaces (e.g., supports installed thereon being horizontally extending in the assembled position). In this case, the noted method may include the steps of positioning one or more linearly aligned supports on the main support surface (e.g., the floor of the building structure) and positioning at least part of this support in the lateral groove on the lowermost of the end surfaces of each panel. Moreover, the method may include the step of positioning one or more linearly aligned supports at least partially within the lateral groove of the uppermost end surface of each panel. When supports are positioned in lateral grooves on the lowermost and/or uppermost end surfaces of the panels, the laterally extending supports may interconnect the various longitudinally extending supports. That is, each of the supports installed on the longitudinal grooves of the various panels may be directly connected to the support(s) installed on the lateral grooves on the uppermost and/or lowermost end surfaces of the various panels. For instance, the laterally extending support(s) may be placed in overlapping relation with the corresponding upper or lower portion of the vertically extending supports. Preferably, adjacent supports installed in the longitudinal grooves of adjacent panels are also directly connected to each other and are also connected to the supports installed on the lateral grooves on the uppermost and/or lowermost end surfaces of the various panels to further increase the structural integrity of the formed wall.

In order to enhance the cost effectiveness of the present invention, the panels may be formed from styrofoam which is both light in weight (e.g., easy for handling by one laborer) and has insulating qualities. Moreover and in this case, grooves may be formed about the entire perimeter area of such panel such that the panel has support members about its entire perimeter. Further, generally U-shaped metal supports of a certain rigidity may be used to provide for a desired degree of structural integrity. Consequently, the assembly of a given wall in accordance with principles of the present invention is cost effective in that the materials are relative inexpensive and in that a wall may be assembled relatively expeditiously.

BRIEF DESCRIPTION OF THE DRAWINGS

FIG. 1 is a perspective view of one embodiment of a panel which may be used in accordance with principles of the present invention;

FIG. 1A is a cross-sectional view of the panel of FIG. 1 taken along line A—A;

FIG. 1B is a cross-sectional view of the panel of FIG. 1 taken along line B—B;

FIG. 2 is a perspective view of one embodiment of a support which may be used in accordance with principles of the present invention;

FIG. 5A is front view of the wall assembly of FIG. 5 illustrating one type of connection of the abutting supports;

FIG. 5B is a perspective view of the wall assembly of FIG. 5 illustrating another type of connection of the abutting supports;

FIG. 6 is a perspective view of another embodiment of a panel which may be used in accordance with principles of the present invention;

FIG. 6A is a cross-sectional view of the panel of FIG. 6 taken along line A—A;

FIG. 6B is a cross-sectional view of the panel of FIG. 6 taken along line B—B;

DETAILED DESCRIPTION

Figure 3:
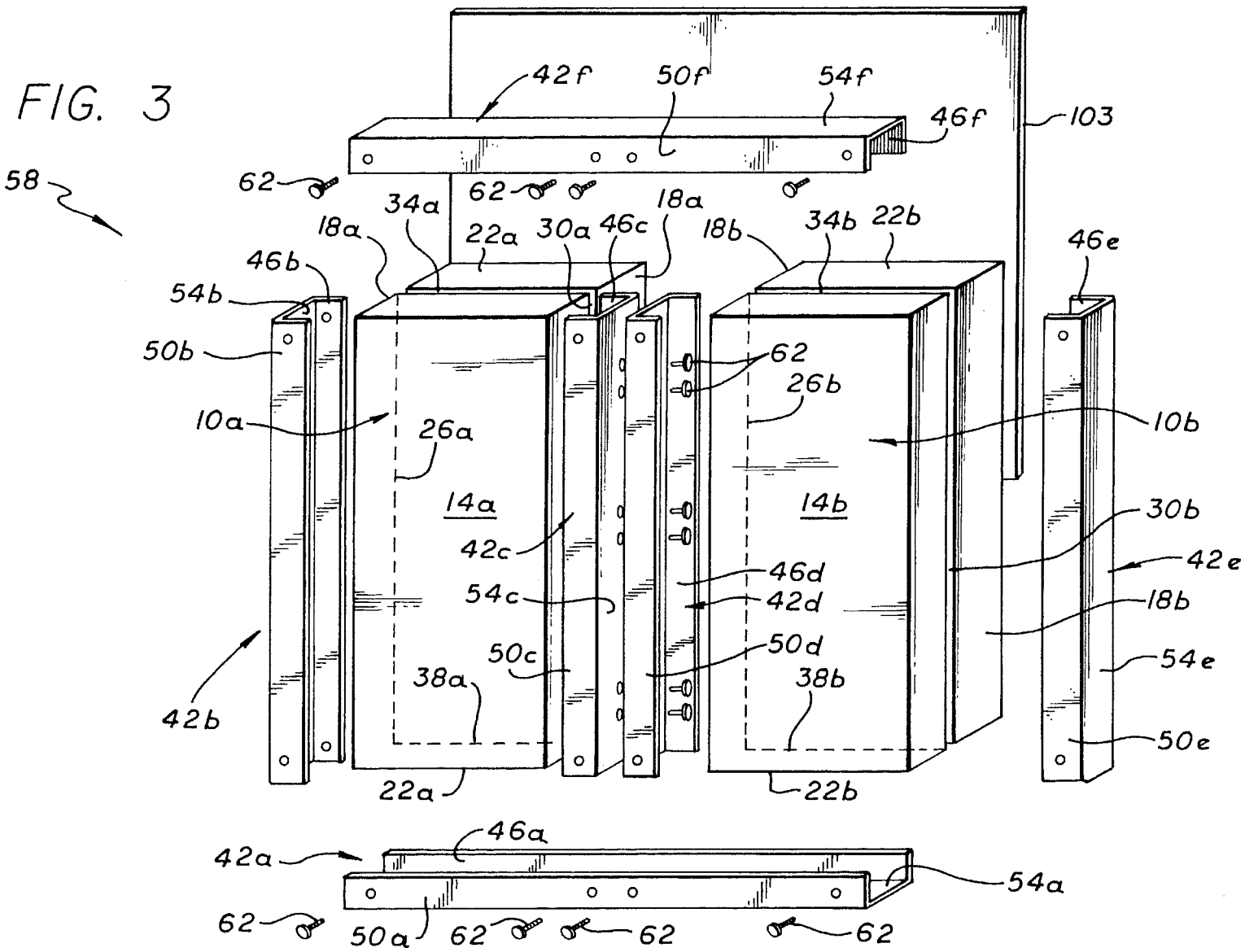
FIG. 3 is an exploded, perspective view of a wall assembly in accordance with principles of the present invention which uses the panels of FIG. 1 and the channels of FIG. 2.

The present invention will be described in relation to the accompanying drawings which assist in illustrating its various features. In this regard and as noted, the present invention is generally directed toward a wall assembly of a building structure. More specifically, the present invention is directed toward a wall assembly which is formed from a plurality of panels having a plurality of preformed grooves thereon and support members which are installed in these grooves and appropriately interconnected.

One type of panel in accordance with principles of the present invention is illustrated in FIGS. 1, 1A, and 1B. Initially, the panel 10 is substantially rectangular and has two main surfaces 14 which define the interior and exterior surfaces, respectively, of the wall assembly, two laterally displaced side surfaces 18, and two longitudinally displaced end surfaces 22. Moreover, the panel 10 has a longitudinally or vertically extending left groove 26 on one of the side surfaces 18, and a longitudinally or vertically extending right groove 30 on the other of the side surfaces 18. Furthermore, the panel 10 has a laterally or horizontally extending top groove 34 positioned on one of the end surfaces 22, and a laterally or horizontally extending bottom groove 38 on the other of the end surfaces 22.

The panel 10 may be formed from a variety of materials. However, a preferred material is styrofoam or more particularly, EPS (expanded polystyrene). Styrofoam is lightweight such that the panels 10 are easy to handle in the assembly procedure to be discussed below. Moreover, styrofoam also has good insulating qualities such that the need for a separate insulation installation procedure may be alleviated when forming a wall assembly in accordance with principles of the present invention. In this regard, panels 10 formed from styrofoam may have an R value of about R-32 (for a panel 10 having a thickness of about 8 inches). Although the present invention is not limited to panels 10 of a specific size, generally the height of the panels 10 (the distance between the two longitudinally displaced end surfaces 22) will range from about eight feet to about twenty-four feet, and will typically be about ten feet, the width of the panels 10 (the distance between the two laterally displaced side surfaces 18) will range from about two feet to about four feet, and will typically be about four feet, and the thickness of the panels 10 (the distance between the two main surfaces 14) will typically range from about four inches to about twelve inches, and will typically be about eight inches.

As noted, supports are positioned within the grooves of the various panels to be discussed herein to provide a frame structure for a wall assembly in accordance with principles of the present invention. One embodiment of a suitable support is illustrated in FIG. 2. The support 42 is generally U-shaped, having first and second legs 46, 50, respectively, with a center leg 54 positioned therebetween. Since the supports 42 effectively define the frame structure of a wall assembly in accordance with principles of the present invention, the supports 42 should be of sufficient rigidity and thus structural integrity. In this regard, the supports 42 may be formed from materials such as steel or other suitable metals/materials, and in one embodiment the supports 42 are formed from light gauge steel (e.g. gauges twelve to twenty-five).

In order to enhance the performance of a wall assembly in accordance with principles of the present invention and/or the assembly procedure itself, the dimensions of the supports 42 and the size and positioning of the various grooves on the various panels disclosed herein (e.g, panel 10, as well as panels 66 and 110 to be discussed below) may be jointly selected. For instance, the thickness of the first and second legs 46, 50, respectively, of the support 42 and the width of the various grooves on the panels may be jointly selected such that the portion of the support 42 which interfaces with a given groove is effectively press-fit therein. Moreover, the length of the first and second legs 46, 50, respectively, of the support 42 should be substantially equal to, and preferably slightly less than, the depth of the various grooves on the panels such that the center leg 54 will abut a portion of the panel when a portion of the support 42 is positioned within one of the grooves. Furthermore, the distance between the first and second legs 46, 50, respectively, is preferably selected to be substantially the same as the distance between the various grooves on the panel and one of its other surfaces such that when one of the legs 46, 50 is positioned within one of the grooves, the other of the legs 46, 50 will be in substantial abutting engagement with one of the main surfaces of the panel or one of its side surfaces.

Figure 3A:
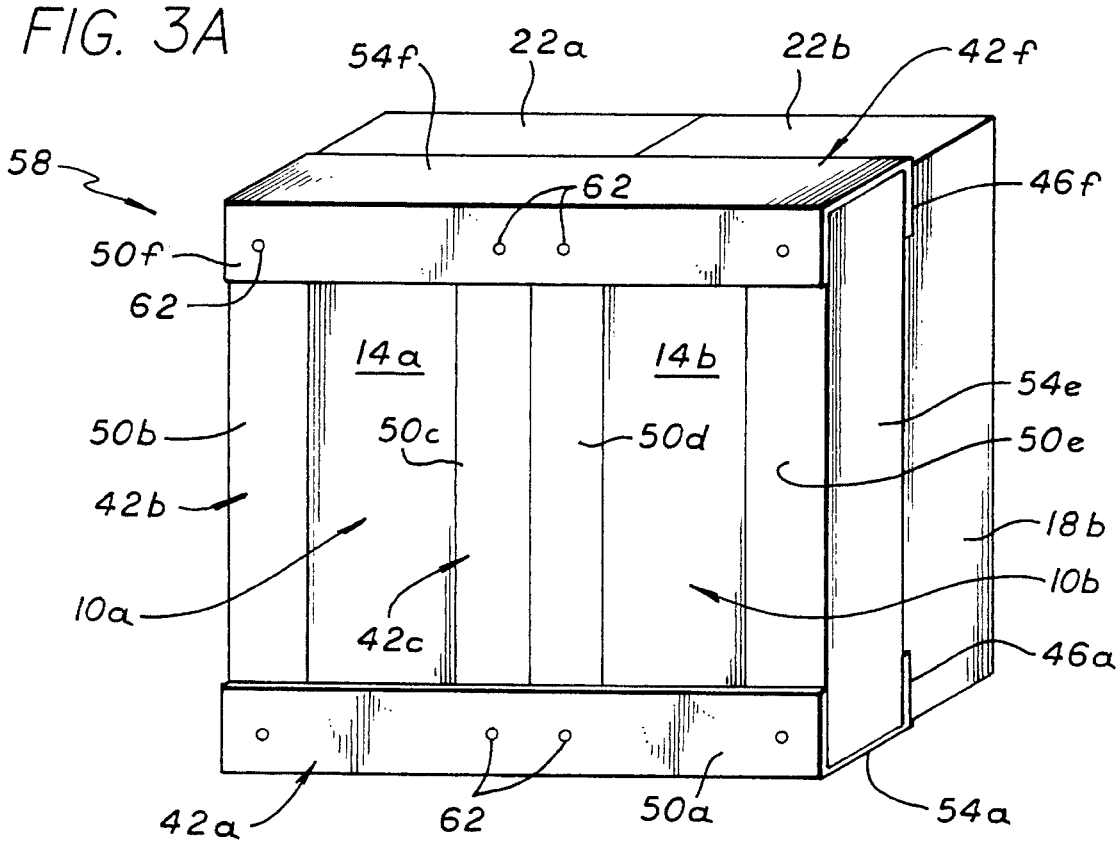
FIG. 3A is front view of the wall assembly of FIG. 3 in the assembled position.
Figure 3B:
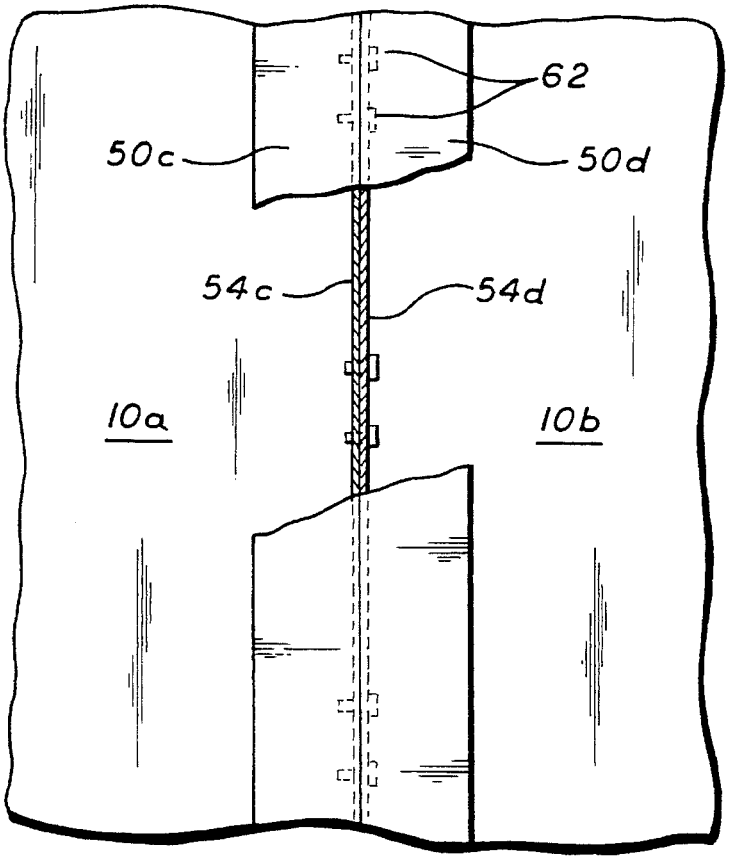
FIG. 3B is a partial cutaway front view of the two panels of FIG. 3 illustrating one type of connection of the abutting supports.

A plurality of the panels 10 and support members 42 may be assembled to form the wall assembly 58 illustrated in FIGS. 3, 3A, and 3B. Although only two panels 10 are illustrated therein, it will be appreciated that the number of panels 10 may be selected to accommodate for a plurality of factors, such as the desired length of the wall assembly 58. That is, any number of panels 10 may be assembled in the manner described herein to form a wall assembly 58 of desired length.

Initially, one or more of the supports 42*a* (only one shown) are linearly aligned and positioned upon the floor (not shown) of the building structure with the first and second legs 46, 50, respectively, projecting upwardly. The support(s) 42*a* may then be secured to the floor (not shown) with suitable fasteners 62 (e.g., screws, bolts, rivets, and/or adhesives), such as by passing these fasteners 62 through the center leg 54 at a plurality of spaced locations along the support(s) 42*a* (not shown). This defines a bottom runner for the wall assembly 58 and extends substantially the entire length thereof.

The panels 10 which form the wall assembly 58 interface with the support(s) 42*a*. In this regard, the panel 10*a* is stood on one of its end surfaces 22*a* with the first leg 46*a* of the support 42*a* being positioned within the bottom groove 38*a* on the panel 10*a*. Once again, it is desirable for the first leg 46*a* to be totally contained within the bottom groove 38*a* and to be snugly received therein. Moreover, preferably the width of the support 42*a* is such that the second leg 50*a* is in substantial abutting engagement with one of the main surfaces 14*a* of the panel 10*a*. However, there may be a slight gap to accommodate for the positioning of the supports 42*b* and 42*c* between the support 42*a* and main surface 14*a*. That is, the support 42*b* is positioned on one of the side surfaces 18*a* of the panel 10*a* with its first leg 46*b* being positioned within the left groove 26*a* of the panel 10*a*, with its center leg 54*b* being in substantial abutting engagement with the corresponding side surface 18*a*, and with its second leg 50*b* being in substantial abutting engagement with one of the main surfaces 14*a*. In this case, it will be appreciated that the support 42*b* may be slid downwardly in the left groove 26*a* until the lower portion thereof is substantially contained within the support 42*a*. When in this position, a portion of the support 42*a* is also in overlapping relation with the lower portion of the support 42*b* such that the overlapping portions of the supports 42*a* and 42*b* may be directly connected together by one or more fasteners 62. In the case where screws and/or rivets are used as fasteners 62, no preexisting holes are required on the supports 42. Notwithstanding the order presented in this aspect of the assembly procedure, it will be appreciated that the support 42*b* may actually be installed on the panel 10*a* prior to installing the panel 10*a* on the support 42*a*, and such is within the scope of the present invention.

The support 42*c* interfaces with the panel 10*a* in a manner similar to that of the support 42*b*, but on the opposite side surface 18*a* of the panel 10*a*. That is, the support 42*c* is installed on the opposite side surface 18*a* of the panel 10*a* with its first leg 46*c* being positioned within the right groove 30*a* of the panel 10*a*, with its center leg 54*c* being in substantial abutting engagement with the corresponding side surface 18*a*, and with its second leg 50*c* being in substantial abutting engagement with the noted main surface 14*a*. Consequently, the lower portion of the support 42*c* is also substantially retained within the support 42*a*. Therefore, a portion of the support 42*a* is in overlapping relation with the lower portion of the support 42*c* such that the overlapping portions of the supports 42*a* and 42*c* may be directly connected together by one or more fasteners 62.

The panel 10*b* may be installed similarly to the panel 10*a*. Although the panels 10*a* and 10*b* may be interconnected solely by the support 42*a* and/or support 42*f* (discussed below), the panels 10*a* and 10*b* may be interconnected in a manner which further enhances the structural integrity of the wall assembly 58. In this regard, the supports 42 on the side surfaces 18 of adjacent panels 10 may be placed in partial abutting relationship and directly connected to each other. More specifically and referring to panels 10*a* and 10*b*, prior to installing the support 42*d* on the panel 10*b*, the support 42*d* may be directly connected to the support 42*c* on the panel 10*a* via the center legs 54*c* and 54*d*. That is, the center leg 54*d* of the support 42*d* is positioned in abutting engagement with the center leg 54*c* of the support 42*c*. The overlapping portions of the center legs 54*c*, 54*d* may then be directly connected to each other by one or more of the fasteners 62 which are preferably spaced along substantially the entirety of the respective lengths of the supports 42*c* and 42*d*. As will be appreciated, it may be desirable to connect the supports 42*c* and 42*d* together before being installed on any panel 10. Moreover, the connection of the supports 42*c* and 42*d* may be established prior to installing the support 42*d* on the panel 10*b* and/or prior to installing the panel 10*a* on the support 42*a* in the above-noted manner.

Once the supports 42*c* and 42*d* are joined together in the above-noted manner, the panel 10*b* is stood on one of its end surfaces 22*b* with the first leg 46*a* of the support 42*a* being installed within the bottom groove 38*b* on the panel 10*b*. Moreover, the support 42*d* is installed on one of the side surfaces 18*b* of the panel 10*b* with its first leg 46*d* being positioned within the left groove 26*b* of the panel 10*b*, with its center leg 54*d* being in substantial abutting engagement with the corresponding side surface 18*b*, and with its second leg 50*d* being in substantial abutting engagement with one of the main surfaces 14*b*. Consequently, the support 42*a* also substantially retains the lower portion of the support 42*d*. Therefore, a portion of the support 42*a* is in overlapping relation with the lower portion of the support 42*d* such that these overlapping portions may thus be directly connected together by one or more fasteners 62. In order to further enhance the structural integrity of the wall assembly 58, an appropriate adhesive (e.g., styrene adhesives) may be positioned on the abutting side surfaces 18 of the panels 10.

The support 42*e* is installed on the panel 10*b* in the manner noted above with regard to the support 42*c* on the panel 10*a* such that the lower portion of the support 42*d* is retained within the support 42*a*. Therefore, a portion of the support 42*a* is in overlapping relation with the lower portion of the support 42*e* such that these overlapping portions may be directly connected together by one or more fasteners 62.

The above-described assembly procedure may be repeated a plurality of times with more than two of the panels 10 until the desired length of the wall assembly 58 is achieved. In order to further improve upon the structural integrity of the wall assembly 58, however, another support 42*f* may be installed in the top grooves 34 of the panels 10 in a manner similar to that in which the support 42*a* is installed on the bottom grooves 38 of the panels 10 and as discussed above. That is, one or more linearly aligned supports 42*f* may be installed to run substantially the entire length of the wall assembly 58. Specifically, the first leg 46*f* of the support(s) 42*f* is positioned within the top groove 34 of each of the panels 10 of the wall assembly 58 (e.g. panels 10*a*, 10*b*), such that the center leg(s) 54*f* of the support(s) 42*f* is positioned in substantial abutting relation with the corresponding end surface 22 of each panel 10 of the wall assembly 58 (e.g., panels 10*a*, 10*b*), and such that the second leg 50*f* of the support(s) 42*f* is in substantial abutting relationship with one of the main surfaces 14 of each of the panels 10 of the wall assembly 58 (e.g, panels 10*a*, 10*b*), although there may be a slight gap as noted above. Consequently, the support 42*f* substantially retains the upper ends of the vertically extending supports 42 (e.g., supports 42*b*, 42*c*, 42*d*, and 42*e*). Therefore, a portion of the second leg 50*f* of the support 42*f* is in overlapping relation with the upper portions of the supports 42 in both the left and right grooves 26, 30, respectively, of each of the panels 10 and such overlapping portions may be directly connected to each other by fasteners 62. Although the support 42*f* has been described as the last step in the installation, it could be installed after the panel 10*a* is stood on its noted end surface 22. However, the installation of additional panels 10 may be more cumbersome than the noted procedure if this sequence is in fact used.

Based upon the foregoing, it will be appreciated that adjacent vertically extending supports 42 are interconnected in a variety of manners. Initially, these supports 42 are directly connected to each other (e.g., supports 42*c* and 42*d*). Moreover, the horizontally extending supports 42 (e.g., support 42*a* and support 42*f*) are each connected to each of the vertically extending supports 42 (e.g., support 42*b*, 42*c*, 42*d*, 42*e*). Although this provides for a desired structural integrity of the wall assembly 58, it will be appreciated various other manners of interconnecting the various supports 42 are within the scope of the present invention. For instance, adjacent and vertically extending supports 42 (e.g., support 42*c* and support 42*d*) need not be directly connected to each other, but instead may be interconnected by being connected to a common horizontally extending support (e.g., via connection to support 42*a* and/or support 42*f*). In this case, the vertically extending supports 42 could be interfaced with the associated panel 10 prior to positioning the panels 10 in abutting engagement. That is, the support 42*d* may be positioned within the left groove 26*b* of the panel 10*b* prior to positioning the panel 10*b* adjacent the panel 10*a*. Notwithstanding these potential variations, the noted procedure is preferred for the structural integrity achieved for the wall assembly 58.

Figure 4:
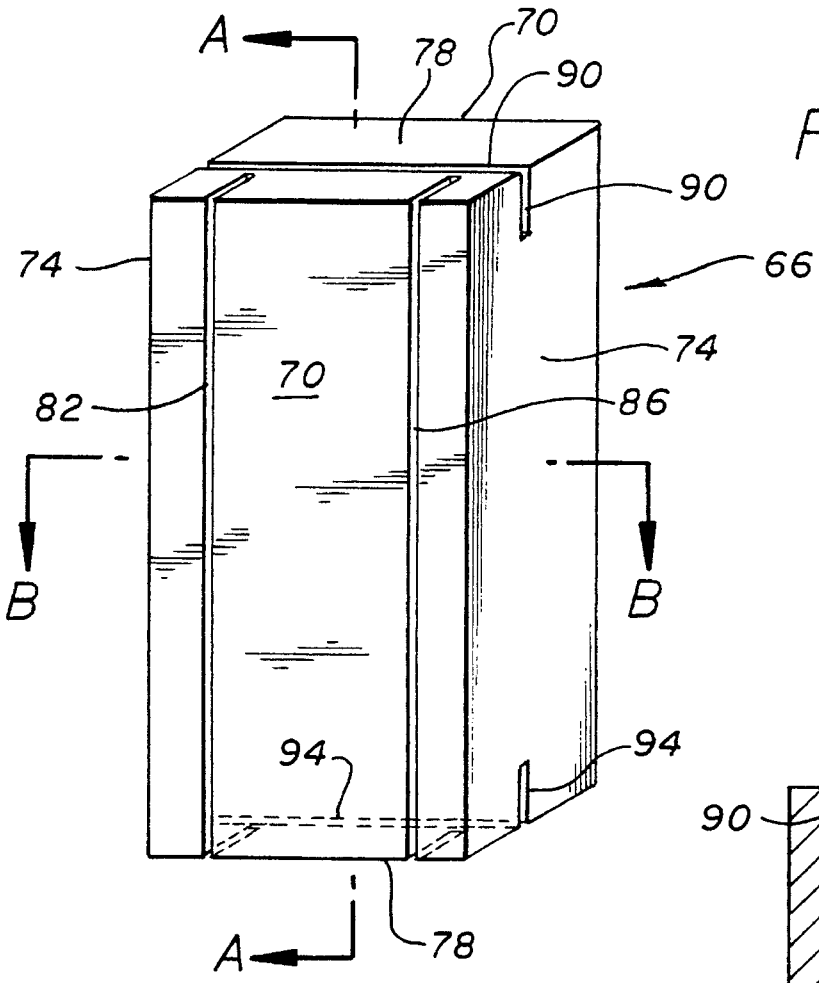
FIG. 4 is a perspective view of another embodiment of a panel which may be used in accordance with principles of the present invention.
Figure 4A:
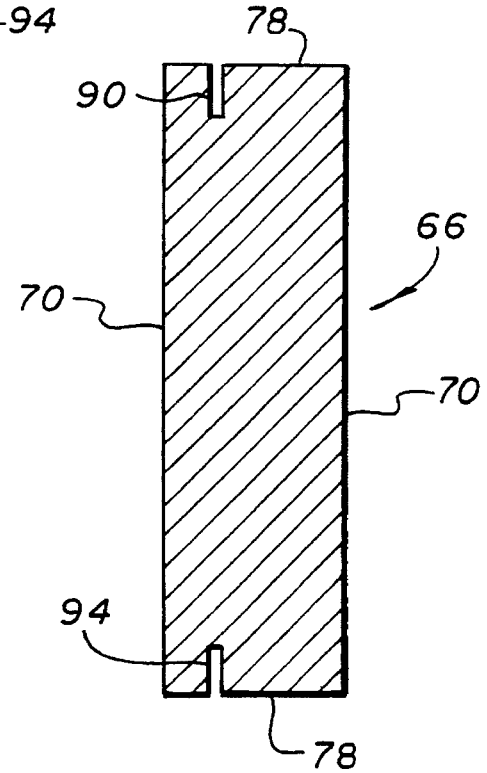
FIG. 4A is a cross-sectional view of the panel of FIG. 4 taken along line A—A.
Figure 4B:
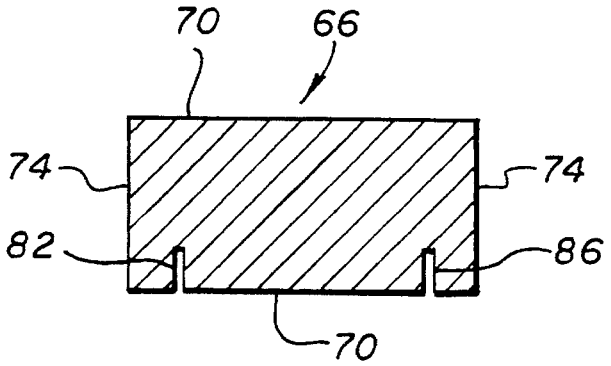
FIG. 4B is a cross-sectional view of the panel of FIG. 4 taken along line B—B.

Another type of panel which may be used in accordance with principles of the present invention is illustrated in FIGS. 4, 4A, and 4B. Initially, the panel 66 is similar to the panel 10 except for the positioning of its grooves. In this regard, the panel 66 is substantially rectangular and has two main surfaces 70 which define the interior and exterior surfaces, respectively, of the wall assembly, two laterally displaced side surfaces 74, and two longitudinally displaced end surfaces 78. Moreover, the panel 66 has a longitudinally or vertically extending left groove 82 on one of the main surfaces 70 proximate one of the side surfaces 74 (e.g., slightly displaced therefrom), and a longitudinally or vertically extending right groove 86 on the main surface 70 proximate the other side surface 74 (e.g., slightly displaced therefrom). Furthermore, the panel 66 has a laterally or horizontally extending top groove 90 positioned on one of the end surfaces 78, and a laterally or horizontally extending bottom groove 94 on the other of the end surfaces 78.

Figure 5:
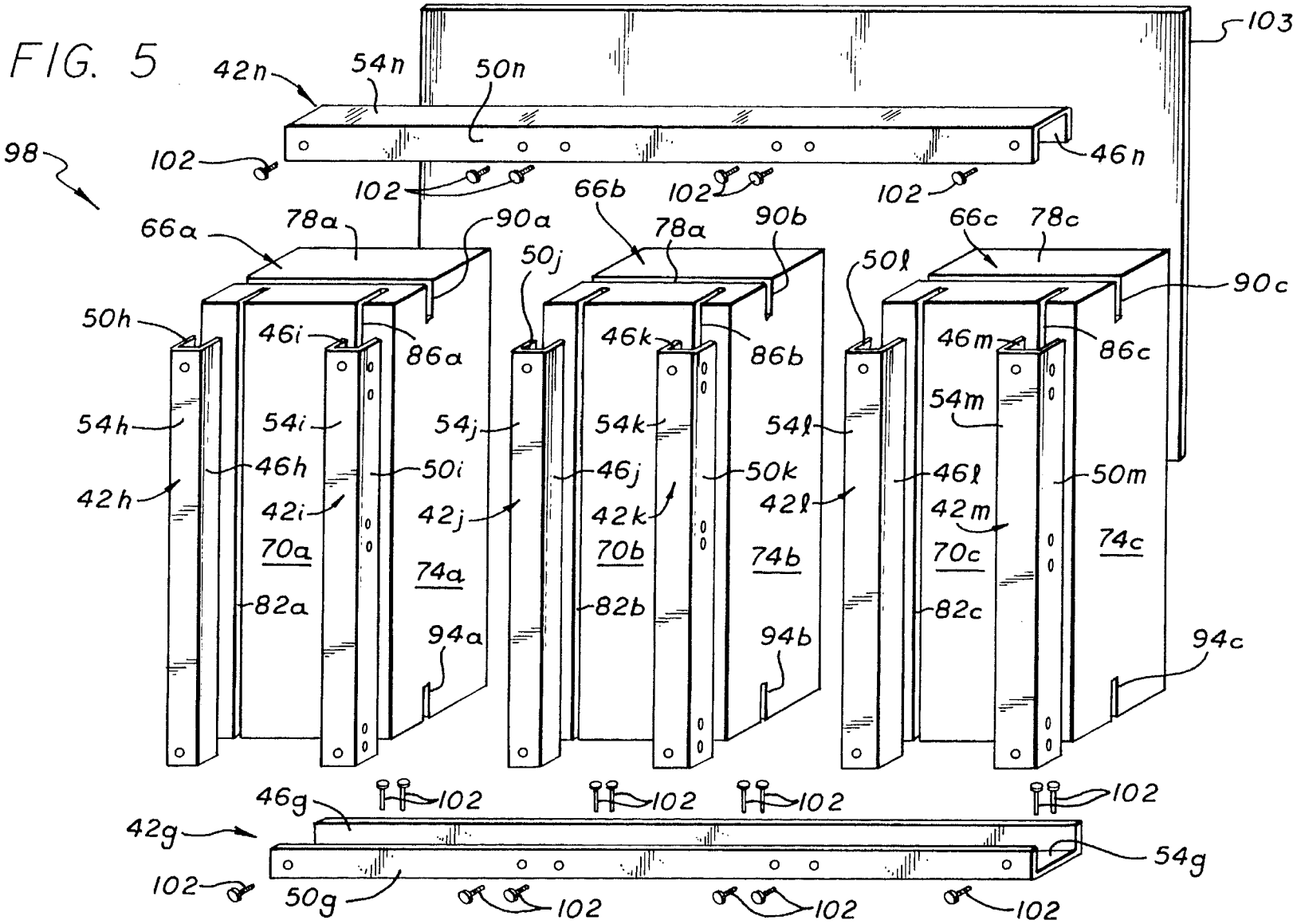
FIG. 5 is an exploded, perspective view of a wall assembly in accordance with principles of the present invention which uses the panels of FIG. 4 and the channels of FIG. 2.

A plurality of the panels 66 and support members 42 may be assembled to form the wall assembly 98 illustrated in FIGS. 5, 5A, and 5B. Although three panels 66 are illustrated in FIG. 5, it will be appreciated that the number of panels 66 may be selected to accommodate for a plurality of factors, such as the desired length of the wall assembly 98. That is, any number of panels 66 may be assembled in the manner described herein to form a wall assembly 98 of desired length.

Initially, one or more of the supports 42*g* (only one shown) are linearly aligned and positioned upon the floor (not shown) of the building structure with the first and second legs 46*g*, 50*g*, respectively, projecting upwardly. The support(s) 42*g* are then secured to the floor (not shown) with fasteners 102, such as by passing these fasteners 102 through the center leg 54*g* at a plurality of spaced locations along the support(s) 42*g*. This defines a bottom runner for the wall assembly 98 and extends substantially the entire length thereof.

The panels 66 which form the wall assembly 98 each interface with the support(s) 42*g*. In this regard, the panel

66*a* is stood on one of its end surfaces 78*a* with the first leg 46*g* of the support 42*g* being positioned within the bottom groove 94*a* on the panel 66*a* and the second leg 50*g* in substantial abutting engagement with the main surface 70*a* of the panel 66*a*. The support 42*h* is positioned on one of the main surfaces 70*a* of the panel 66*a* with its second leg 50*h* being positioned in substantial abutting engagement with one of the side surfaces 74*a*, with its center leg 54*h* being in substantial abutting engagement with the main surface 70*a*, and with its first leg 46*h* being positioned within the left groove 82*a* on the panel 66*a*. In this case, it will be appreciated that the support 42*h* may be slid into and downwardly in the left groove 82*a* until the lower portion thereof is substantially retained within the support 42*g*. When in this position, a portion of the support 42*g* is in overlapping relation with the lower portion of the support 42*h* such that these overlapping portions may be directly connected together by one or more fasteners 102. Notwithstanding the order presented in this portion of the assembly procedure, it will be appreciated that the support 42*h* may be installed on the panel 66*a* prior to installing the panel 66*a* on the support 42*g*, and such is within the scope of the present invention.

The support 42*i* interfaces with the panel 66*a* in a manner similar to that of the support 42*h*, but on the opposite side of the panel 66*a*. That is, the support 42*i* is installed with its first leg 46*i* being positioned within the right groove 86*a* of the panel 66*a*, with its center leg 54*i* being in substantial abutting engagement with the main surface 70*a*, and with its second leg 50*i* being in substantial abutting engagement with one of the side surfaces 74*a*. Consequently, the lower portion of the support 42*i* is substantially retained within the support 42*g*. Therefore, a portion of the support 42*g* is in overlapping relation with the lower portion of the support 42*i* and these overlapping portions may be directly connected together by one or more fasteners 102.

The panel 66*b* may be installed similarly to the panel 66*a* by installing the supports 42*j* and 42*k* on the panel 66*b* in its left and right grooves 82*b*, 86*b*, respectively. Although the panels 66*a*, 66*b* may be interconnected solely by the support 42*g* and/or 42*n* (discussed below), the panels 66*a*, 66*b* may be further interconnected in a manner which enhances the structural integrity of the wall assembly 98. More specifically and with the supports 42*j* and 42*k* in the noted position, the panel 66*b* is stood on one of its end surfaces 78*b* with the first leg 46*g* of the support 42*g* being positioned within the bottom groove 94*b* on the panel 66*b*. As a result, the lower portions of each of the supports 42*j* and 42*k* are retained within the support 42*g* and a portion of the support 42*g* is in overlapping relation with each of these lower portions. The panel 66*b* is thereafter positioned adjacent the panel 66*a* such that the second leg 50*i* of the support 42*i* and the second leg 50*j* of the support 42*j* are in substantial abutting relation. In this position, the portion of the support 42*g* in overlapping relation with the support 42*j* may be directly connected thereto by one or more fasteners 102, and the portion of the support 42*g* in overlapping relation with the support 42*k* may be similarly directly connected thereto by one or more fasteners 102. Moreover, the supports 42*i* and 42*j* may be directly connected to each other, such as by welding the supports 42*i* and 42*j* together at a plurality of locations 106. Alternatively, a connector piece (not shown) could be directly connected to the center leg 54*i* of the support 42*i* via one or more fasteners 102 and to the center leg 54*j* of the support 42*j* by one or more fasteners 102.

Instead of installing the support 42*j* in the above-noted manner, it could alternatively be directly connected to the support 42*i* prior to being installed on the panel 66*b* (and/or prior to installing the support 42*i* on the panel 66*a*) as illustrated in FIG. 5A. That is, the second leg 50*j* of the support 42*j* could be placed in the noted abutting relationship with the second leg 50*i* of the support 42*i* and directly connected thereto by one or more fasteners 102. However, establishing this type of interconnection may be more difficult than the above-noted procedure. In any case, once the supports 42*i* and 42*j* were connected to each other, the panel 66*b* may be installed on the support 42*j* in the above-noted manner and installed on the support 42*g* in the above-noted manner. As with the panels 10 noted above, it may be desirable to use the noted adhesives on the side surfaces 74 of the panels 66 to further enhance the structural integrity of the wall assembly 98.

The above-described assembly procedure may be repeated a plurality of times with a plurality of the panels 66 until the desired length of the wall assembly 98 is achieved. For instance, a third panel 66*c* may be installed in a manner similar to the panel 66*b* noted above. Nonetheless, when the desired length of the wall assembly 98 is achieved and in order to further improve upon the structural integrity of the wall assembly 98, another support 42*n* may be installed on the top grooves 90 of the various panels 66 in a manner similar to that in which the support 42*g* is installed on the bottom grooves 94 of the panels 66 and as discussed above. That is, one or more linearly aligned supports 42*n* may be installed such that its first leg 46*n* of the support(s) 42*n* is positioned within the top groove 90 of each of the panels 66 (e.g. panels 66*a*, 66*b*, 66*c*), such that its center leg(s) 54*n* of the support 42*n* is positioned in substantial abutting relation with the corresponding end surface 78 of each panel 66, and such that its second leg 50*n* is in substantial abutting relation with one of the main surfaces 70 of each of the panels 66. Consequently, the support 42*n* substantially retains the upper ends of the vertically extending supports 42 (e.g, supports 42*h*, 42*i*, 42*j*, 42*k*, 42*l*, 42*m*). Therefore, a portion of the first leg 46*n* is in overlapping relation with the upper portions of the supports 42 in both the left and right grooves 82, 86, respectively, of each of the panels 66 and these overlapping portions may be directly connected to each other by fasteners 102. Although the support 42*n* has been described as the last step in the installation, it could be installed after the panel 66*a* is stood on its end surface 74*a*. However, the installation of additional panels 66 thereafter may be more cumbersome than the noted procedure.

Based upon the foregoing, it will be appreciated that adjacent vertically extending supports 42 may be interconnected in a variety of manners. Initially, these supports 42 are directly connected to each other (e.g., supports 42*i* and 42*j* are directly connected; supports 42*k* and 42*l* are directly connected). Moreover, the horizontally extending supports 42 (e.g., support 42*g* and support 42*n*) are each connected to each of the vertically extending supports 42 (e.g., support 42*h*, 42*i*, 42*j*, 42*k*, 42*l*, and 42*m*). Although this provides for a desired structural integrity of the wall assembly 58, it will be appreciated various other manners of interconnecting the various supports 42 are within the scope of the present invention. For instance, adjacent and vertically extending supports 42 (e.g., support 42*i* and support 42*j*) need not be directly connected to each other, but instead may be interconnected by being connected to a common horizontally extending support (e.g., via connection to support 42*g* and/or support 42*n*). Notwithstanding the potential variations for interconnection of supports 42, the noted procedure is preferred for the structural integrity achieved for the wall assembly 98.

Another type of panel which may be used in accordance with principles of the present invention is illustrated in FIGS. 6, 6A, and 6B. Initially, the panel 110 is similar to the panel 10 except for the positioning of its grooves. In this regard, the panel 110 is substantially rectangular and has two main surfaces 114 which define the interior and exterior surfaces, respectively, of the wall, two laterally displaced side surfaces 118, and two longitudinally displaced end surfaces 122. Moreover, the panel 110 has two longitudinally or vertically extending left grooves 126 on one of its side surfaces 118, and two longitudinally or vertically extending right grooves 130 on the other of its side surfaces 118. Furthermore, the panel 110 has two laterally or horizontally extending top grooves 134 positioned on one of the end surfaces 122, and two laterally or horizontally extending bottom grooves 138 on the other of the end surfaces 122.

Figure 7:
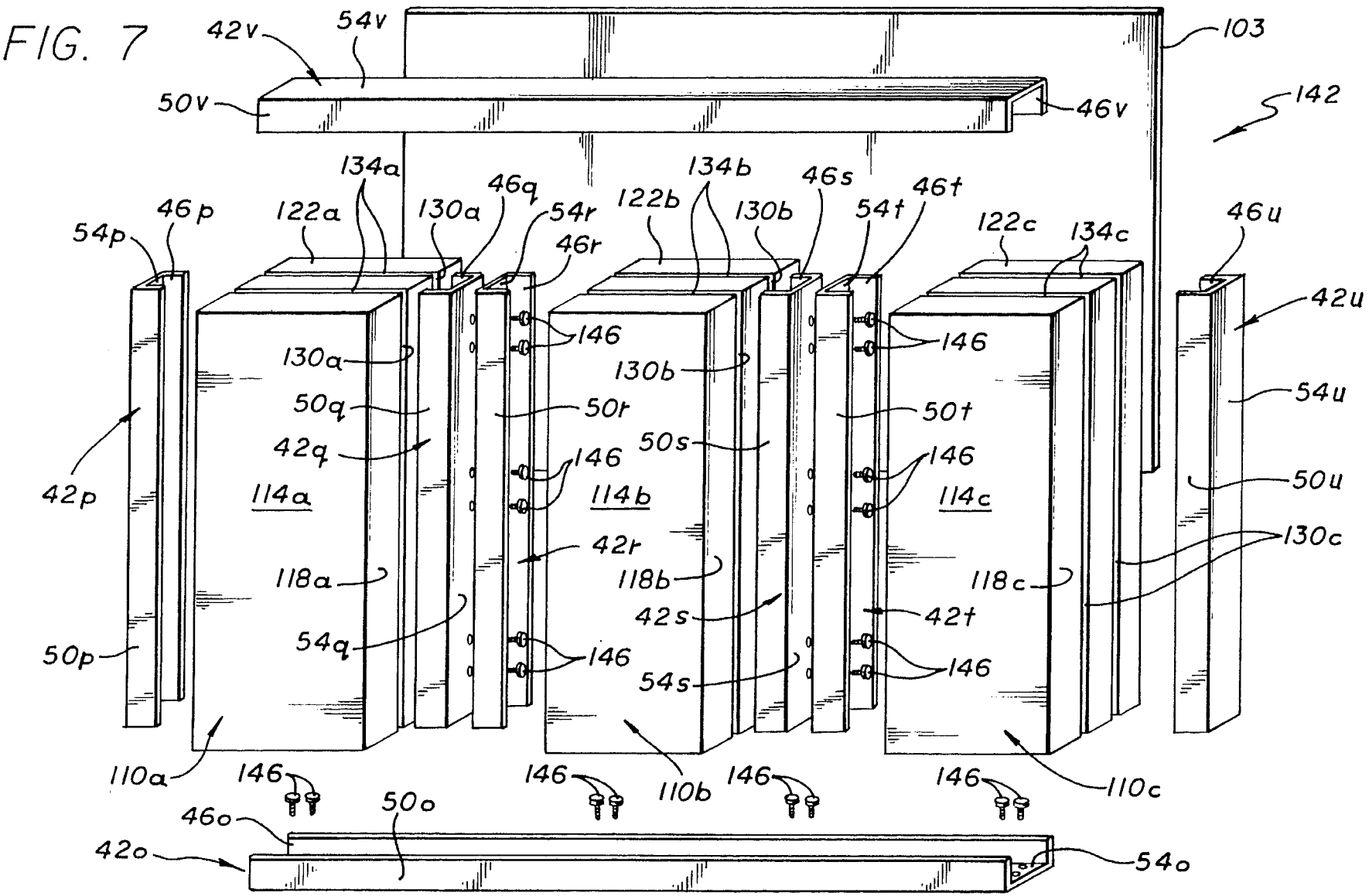
FIG. 7 is an exploded, perspective view of a wall assembly in accordance with principles of the present invention which uses the panels of FIG. 6 and the channels of FIG. 2.

A plurality of the panels 110 and support members 42 may be assembled to form the wall assembly 142 illustrated in FIG. 7. Although three panels 110 are illustrated in FIG. 7, it will be appreciated that the number of panels 110 may be selected to accommodate for a plurality of factors, such as the desired length of the wall assembly 142. That is, any number of panels 110 may be assembled in the manner described herein to form a wall assembly 142 of desired length.

Initially, one or more of the supports 42*o* (only one shown) are linearly aligned and positioned upon the floor (not shown) of the building structure with the first and second legs 46*o*, 50*o*, respectively, projecting upwardly. The support(s) 42*o* may then be secured to the floor (not shown) with suitable fasteners 146 (e.g., screws, bolts, rivets), such as by passing these fasteners 146 through the center leg 54*o* at a plurality of spaced locations along the support(s) 42*o*. This defines a bottom runner for the wall assembly 142 and extends substantially the entire length thereof.

The panels 110 which form the wall assembly 142 interface with the support(s) 42*o*. In this regard, the panel 110*a* is stood on one of its end surfaces 122*a* with the first leg 46*o* and second leg 50*o* of the support 42*o* being positioned within the two bottom grooves 138*a* on the panel 110*a*. The support 42*p* is positioned on one of the side surfaces 118*a* of the panel 110*a* with its first leg 46*p* and second leg 50*p* being positioned within the two left grooves 126*a* of the panel 110*a* and with its center leg 54*p* being in substantial abutting engagement with the corresponding side surface 118*a*. In this case, it will be appreciated that the support 42*p* may be slid into and downwardly in the left grooves 126*a* until the lower portion thereof is substantially contained within the support 42*o*. When in this position, a portion of the support 42*o* is also in overlapping relation with the lower portion of the support 42*p* such that the overlapping portions of the supports 42*o* and 42*p* may be directly connected together by one or more fasteners 146. However, since the supports 42*o* and 42*p* are effectively embedded within the panel 110*a*, it may be necessary to remove a portion of the panel 110*a* in order to establish this connection. Notwithstanding the order presented in this aspect of the assembly procedure, it will be appreciated that the support 42*p* may be installed on the panel 110*a* prior to installing the panel 110*a* on the support 42*o*, and such in within the scope of the present invention.

The support 42*q* interfaces with the panel 110*a* in a manner similar to that of the support 42*p*, but on the opposite side surface 118 of the panel 110*a* and thus the installation thereof will not be repeated. Moreover, the support 42*q* may be installed after the panel 110*a* is installed on the support 42*o* or prior thereto.

The panel 110*b* may be installed similarly to the panel 110*a*. Although the panels 110*a* and 110*b* may be interconnected solely by the support 42*o* and/or support 42*v* (discussed below), the panels 110*a* and 110*b* may be further interconnected in a manner which enhances the structural integrity of the wall assembly 142. In this regard, the supports 42 on the side surfaces 118 of adjacent panels 110 may be placed in partial abutting relationship and directly connected to each other. More specifically and referring to panels 110*a* and 110*b*, prior to installing the support 42*r* on the panel 110*b*, the support 42*r* may be directly connected to the support 42*q* on the panel 110*a* (or even prior to installing the support 42*q* on the panel 110*a*). That is, the center leg 54*r* of the support 42*r* is positioned in substantial abutting engagement with the center leg 54*q* of the support 42*q*. The overlapping portions of the center legs 54*q*, 54*r* may then directly connected to each other by one or more of the fasteners 146 which are preferably spaced along substantially the entirety of the respective lengths of the supports 42*q* and 42*r*. As will be appreciated, this connection of the supports 42*q* and 42*r* must be established prior to installing both of the supports 42*q* and 42*r* on the panels 110*a* and 110*b*.

Once the supports 42*q* and 42*r* are joined together in the above-noted manner, the panel 110*b* is stood on one of its end surfaces 122*b* with the first leg 46*o* and second leg 50*o* of the support 42*o* being installed within the two bottom grooves 138*b* on the panel 110*b*. Moreover, the support 42*r* is installed on one of the side surfaces 118*b* of the panel 110*b* with its first leg 46*r* and its second leg 50*r* being positioned within the two left grooves 126*b* of the panel 110*b* and with its center leg 54*r* being in substantial abutting engagement with the corresponding side surface 118*b*. Consequently, the support 42*o* also substantially retains the lower portion of the support 42*r*. Therefore, a portion of the support 42*o* is in overlapping relation with the lower portion of the support 42*r* such that these overlapping portions may thus be directly connected together (not shown) by one or more fasteners 146. In order to further enhance the structural integrity of the wall assembly 142, an appropriate adhesive may be positioned on the abutting side surfaces 118 of the panels 110.

The support 42*s* is installed on the panel 110*b* in the same general manner as support 42*r*. Moreover, the panel 110*c* is installed in the same general manner as the panel 110*b*, with the supports 42*s* and 42*t* being installed similarly to supports 42*q* and 42*r*. This general assembly procedure may be repeated a plurality of times with more than three of the panels 110 until the desired length of the wall assembly 142 is achieved. In order to further improve upon the structural integrity of the wall assembly 142, however, another support 42*v* is installed in the top grooves 134 of the panels 110 in a manner similar to that in which the support 42*o* is installed on the bottom grooves 138 of the panels 110 and as discussed above. That is, one or more linearly aligned supports 42*v* are installed to run substantially the entire length of the wall assembly 142. Specifically, the first leg 46*v* and second leg 50*v* of the support(s) 42*v* are positioned within the two top grooves 134 of each of the panels 110 of the wall assembly 142 (e.g. panels 110*a*, 110*b*, 110*c*), such that the center leg(s) 54*v* of the support(s) 42*v* is positioned in substantial abutting relation with the corresponding end surface 122 of each panel 110 of the wall assembly 142. Moreover, the support 42*v* substantially retains the upper ends of the vertically extending supports 42 (e.g., supports 42*p*, 42*q*, 42*r*, 42*s*, 42*t*, and 42*u*). Therefore, a portion of the first leg 46*v* and second leg 50*v* of the support 42*v* are each in overlapping relation with the upper portions of the supports 42 in both the left and right grooves 126, 130, respectively, of each of the panels 10 and such overlapping portions may be directly connected to each other (not shown) by fasteners 146. Although the support 42*v* has been described as the last step in the installation, it could be installed after the first panel 110*a* is stood on its end surface 122. However, the installation of additional panels 110 may be more cumbersome than the noted procedure if this sequence is used.

Figure 8A:
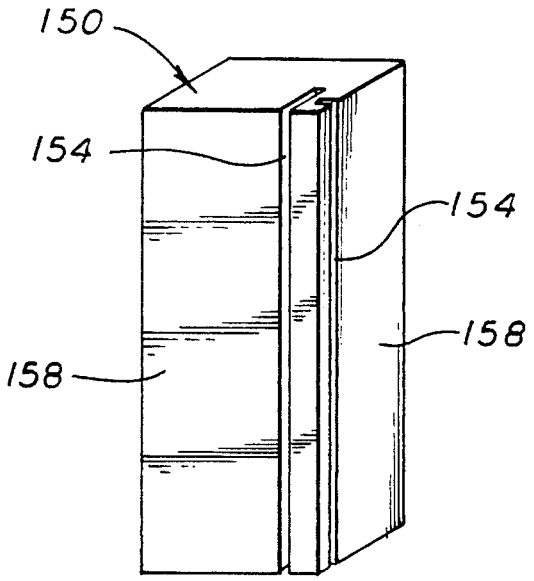
FIG. 8A is a perspective view of a corner panel for interconnecting adjacent wall assemblies.
Figure 8B:
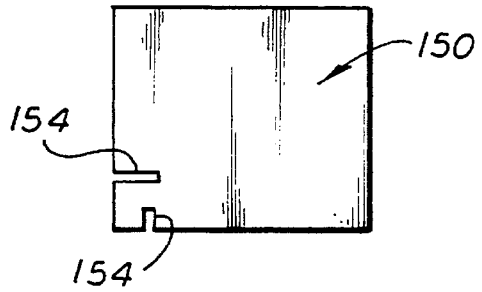
FIG. 8B is a top view of the corner panel of FIG. 8A.
Figure 9:
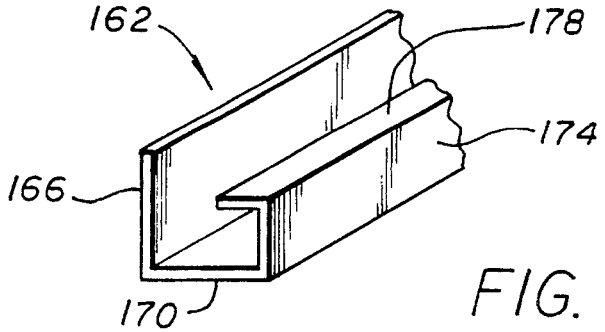
FIG. 9 is a perspective view of a corner support member.
Figure 10:
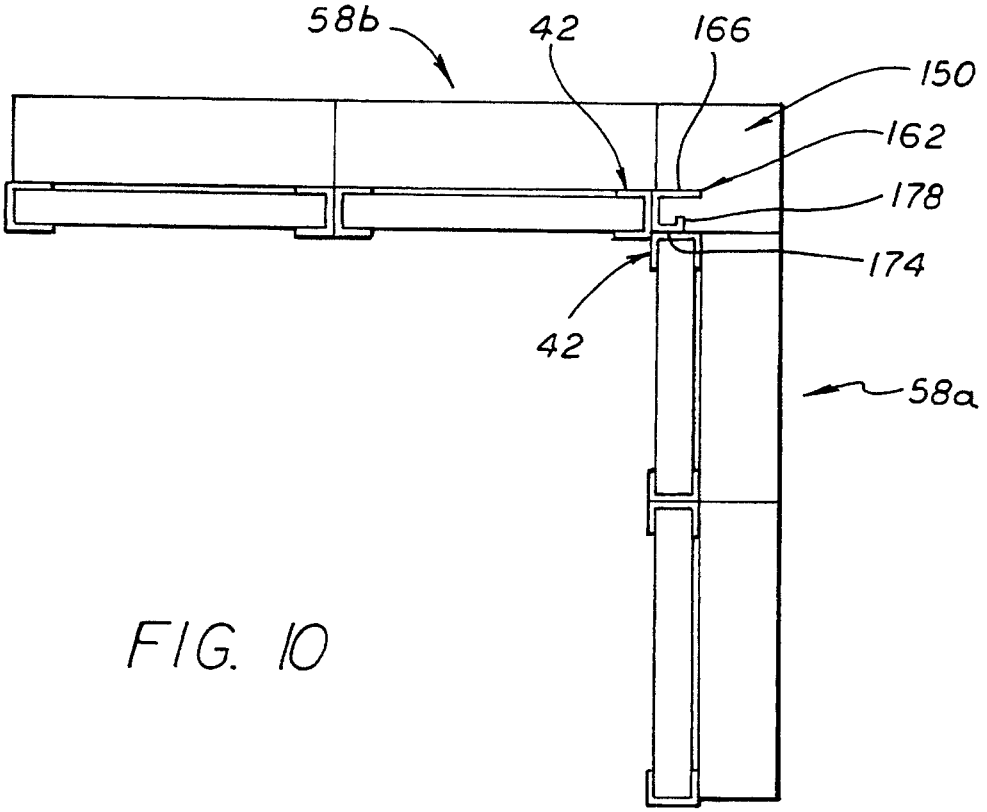
FIG. 10 is a top view of two adjacent wall assemblies, without a top support thereon, in accordance with principles of the present invention and with the corner panel of FIGS. 8A–B and corner support member of FIG. 9 providing for an interconnection therebetween.

The above-noted wall assemblies may be used to form each of the walls of a given building structure. One manner for interconnecting adjacent walls is illustrated in FIGS. 8–10. A corner panel 150 is illustrated in FIGS. 8A and 8B. The corner panel 150 has two longitudinally oriented grooves 154 on adjacent surfaces 158 of the corner panel 150. The grooves 154 are positioned such that a support member 162, shown in FIG. 9, can slidably engage the corner panel 150. Generally, the support member 162 would typically be the same length as the height of the panel 150, would be formed from materials similar to the supports 42, and would have a rigidity or structural integrity similar to that of the supports 42. Moreover, the support 162 has first leg 166, a second leg 170, a third leg 174, and a fourth leg 178.

The corner panel 150 and support member 162 may be used to interconnect two adjacent wall assemblies 58 in the manner illustrated in FIG. 10. Generally, the second leg 170 of the support member 162 is positioned in an abutting relationship with a portion of one of the supports 42 of wall assembly 58*b* and such are appropriately interconnected. Moreover, the third leg 174 is positioned in abutting relationship with a portion of one of the supports 42 of the wall assembly 58*a* and such are appropriately interconnected. Thereafter, the corner panel 150 may then slidably engage the corner support member 162 by passing the first and fourth legs 166, 178, respectively, within the grooves 154.

Once a wall assembly has been erected in accordance with principles of the present invention, an interior surface may be attached and/or applied thereto in order to provide an aesthetically pleasing, durable surface which can support a plurality of wall hangings (e.g. pictures, clocks). An interior surface of dry wall or wood, for example, can be attached to the interior surface of the wall assembly at a plurality of locations, preferably along the supports 42 which function as studs. In this regard, it is desirable to assemble a wall assembly wherein a leg 46, 50 or 54 of the supports 42 are in an abutting relationship with the interior main surface of the associated panel. Such embodiments readily provide a leg of the support members 42 upon which an interior surface may be attached.

An exterior surface may be attached and/or applied to the exterior main surface of the panels in order to provide a durable, weather resistant surface. Generally, the exterior surface is attached to the surface and may be formed from a variety of materials. However, a preferred material is stucco (e.g., synthetic stucco) or more particularly, a mixture of cement, sand, lime, and water which may be applied to the exterior main surface(s) of the panel(s). In addition, the exterior surface may also be formed from a plurality of slats, or more particularly, wood or metal siding which may be attached to a plurality of legs 50 or 54 of supports 42 at a number of locations. In order to accommodate such interior and exterior wall surfaces, a wall assembly may be constructed upon which a plurality of the noted supports 42 may be on both the interior and exterior main surfaces of the panels. Generally and as shown in FIGS. 6, 6A and 6B, such an embodiment of the present invention would be assembled by providing panels that have two longitudinally or vertically extending left grooves 126 on one of its side surfaces 118, and two longitudinally or vertically extending right grooves 130 on the other of its side surfaces. Furthermore, such a panel would have two laterally or horizontally extending top grooves 134 positioned on one of the end surfaces 122, and two laterally or horizontally extending bottom grooves 138 on the other end surface 122. Instead of positioning one support 42 within both grooves on a given end or side surface, only one support 42 would be installed per groove (not shown). Therefore, supports 42 would be available on both the interior and exterior surfaces of the panel for attaching structure thereto.

Figure 11A:
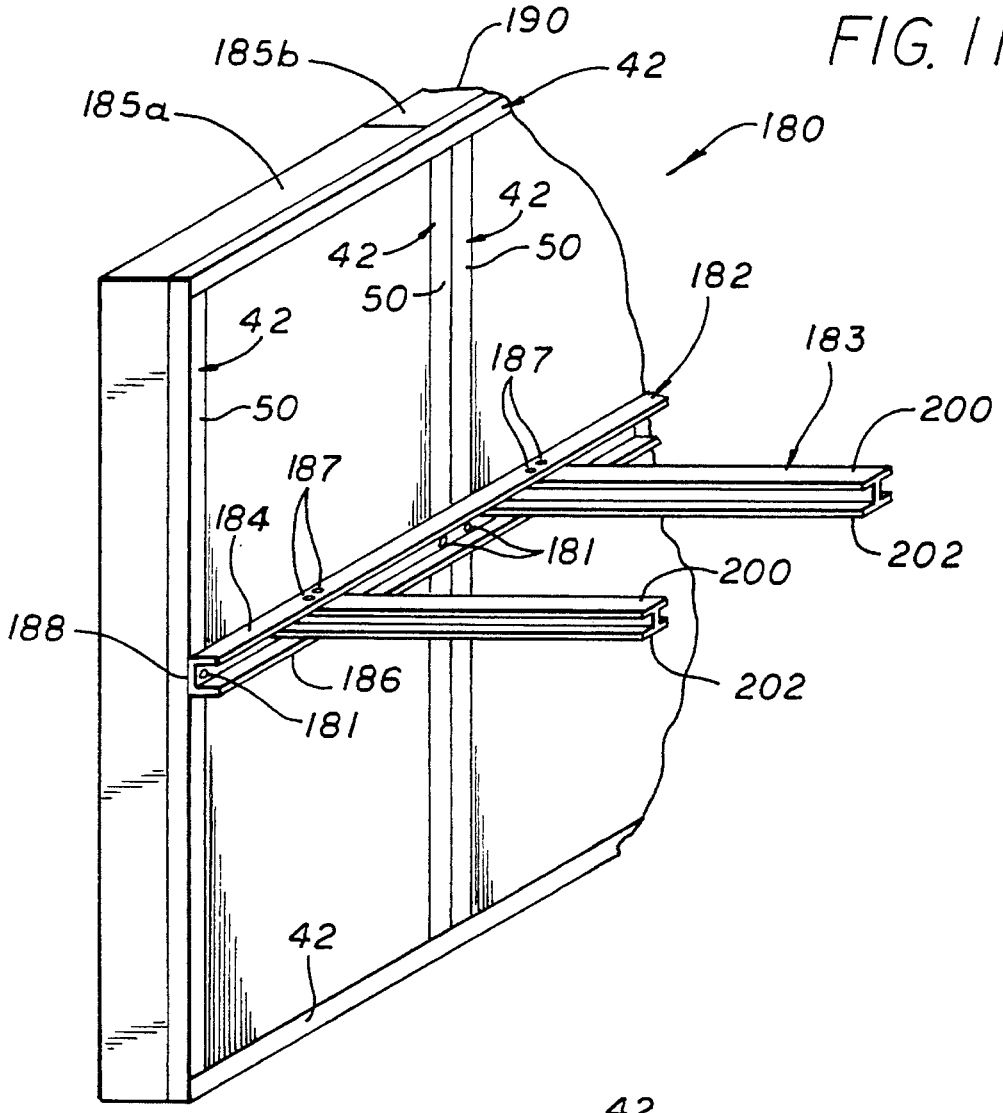
FIG. 11A is a perspective view of a portion of a wall assembly in accordance with principles of the present invention with a rim joist and interfacing floor joists for supporting a floor and/or ceiling.
Figure 11B:
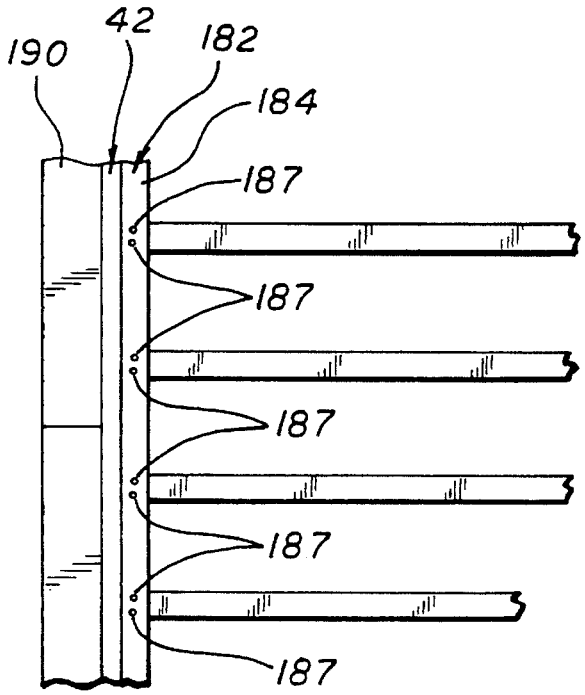
FIG. 11B is a top view of the wall assembly, rim joist, and I-shaped floor joists illustrated in FIG. 11A.

A floor and/or ceiling may also be interconnected with the various wall assemblies described herein. In this regard and referring to FIGS. 11A–11B, this may be accomplished through the use of generally U-shaped rim joists 182 and appropriately configured floor joists 183. Generally, after opposing one wall assemblies have been erected in accordance with the principles of the present invention, a leg 188 of a rim joist 182 may be positioned in abutting relationship with a number of the vertical supports 42 which lie in an abutting relationship to a main surface of one of the wall assemblies and fastened to these supports 42 at a plurality of locations 181. A rim joist 182 may be similarly attached to an opposing wall assembly (not shown). Once the rim joists 182 are secured to the supports 42, the floor joists 186 may be positioned such that the legs 200, 202 of the floor joists 183 lie in an abutting relationship between the legs 184 and 186 of the opposing rim joists 182. As illustrated, the height of the I-shaped floor joists 183 generally correspond to the length of the leg 188 of the rim joist 182. Typically, the leg 188 of the rim joist 182 or the distance between legs 184 and 186 of the rim joist 182 measures about 9 inches. The floor joists 183 should be appropriately spaced along the length of the rim joist 182 in order to adequately support a second floor and/or ceiling surface. In addition, the rim joist 182 should be fastened to the floor joist 188 along a plurality of locations 187 (e.g. screws, bolts). The opposite ends of the floor joists 18 may then be fastened to an opposing rim joist 182 (not shown) attached to an opposing wall assembly (not shown). Thereafter, an appropriate material, such as wood, may be placed about the floor joists 183 in order to form a floor or ceiling surface (not shown).

The foregoing description of the present invention has been presented for purposes of illustration and description. However, the description is not intended to limit the invention to the form disclosed herein. Consequently, variations and modifications of that described herein, commensurate with the above teachings and/or the skill and knowledge of the relevant art, are within the scope of the present invention. The embodiments described hereinabove are further intended to explain best modes known of practicing the invention and to enable others skilled in the art to utilize the invention in such or other embodiments and with the various modifications required by the particular applications or uses of the present invention. It is intended that the appended claims be construed to include alternative embodiments to the extent permitted by the prior art.

What is claimed is:

1. A wall assembly for a building structure formed from a plurality of panels and support members, each said panel having first and second main surfaces, first and second longitudinally extending and laterally displaced side surfaces, first and second laterally extending and longitudinally displaced end surfaces, and at least two longitudinal grooves which are laterally displaced, each said support member being linearly extending, said wall comprising:

a first of said panels positioned on said first end surface of said first panel, said first panel main surface having an uninterrupted surface; a first of said supports installed on said first panel and interfacing with at least one of said longitudinal grooves on said first panel;

a second of said panels positioned on said first end surface of said second panel, wherein one of said side surfaces of said first panel is positioned in substantial abutting relation with one of said side surfaces of said second panel;

a second of said supports installed on said second panel and interfacing with at least one of said longitudinal grooves on said second panel; and means for interconnecting said first and second supports.

2. A wall assembly, as claimed in claim 1, wherein:

one of said at least two longitudinal grooves is on said first side surface of each said panel and the other of said at least two longitudinal grooves is on said second side surface of each said panel; and; said supports are U-shaped;

each said panel further comprises at least one lateral groove on each of said first and second end surfaces; and said wall further comprises a third support installed on said first and second panels and interfacing with each of said lateral grooves on said first end surfaces of said first and second panels, and a fourth support installed on said first and second panels and interfacing with each of said lateral grooves on said second end surfaces of said first and second panels.

3. A wall assembly, as claimed in claim 1, further comprising:

a rim joist having a U-shaped portion, said rim joist being attached to each of said first and second supports at a location between said first and second end surfaces of said panels, said U-shaped portion of said rim joist projecting outwardly away from said panels to receive a plurality of floor joists, and, said first and second supports are U-shaped.

4. The wall assembly claimed in claim 1 wherein one of said at least two longitudinal grooves is on said first main surface of each said panel and the another of said at least two longitudinal grooves is on said first main surface of each said panel one each near to said first and second side surfaces.

5. The wall assembly claimed in claim 1 wherein one of said at least two longitudinal grooves is on said first main surface of each said panel and another of said at least two longitudinal grooves is on said first main surface of each said panel one each near to said first and second side surfaces and said main surface is continuous and substantially planar between said main surface longitudinal grooves.

6. The wall assembly claimed in claim 1 wherein said longitudinal grooves are adapted to grip tightly said supports.

7. The wall assembly claimed in claim 1 wherein said at least two longitudinal grooves comprise at least four lateral grooves divided into two pairs of grooves on each of the first and said second side surfaces of said main panel such that said support members are centrally located with respect to said side surfaces of said main panel.

* * * * *